United States Patent [19]

Loper

[11] 4,077,237

[45] Mar. 7, 1978

[54] CODED CHARM DEVICE

[76] Inventor: Vernon L. Loper, 1995 Winfield Dr., Lakewood, Colo. 80215

[21] Appl. No.: 662,674

[22] Filed: Mar. 1, 1976

[51] Int. Cl.[2] ..... A44C 25/00
[52] U.S. Cl. ..... 63/31
[58] Field of Search ..... 63/31, 20, 2, 19

[56] References Cited

U.S. PATENT DOCUMENTS

| | | | |
|---|---|---|---|
| 397,774 | 2/1889 | Briggs | 63/19 X |
| 566,617 | 8/1896 | Patterson | 63/2 X |
| 569,100 | 10/1896 | Gunther | 63/20 X |
| 784,077 | 3/1905 | Smith et al. | 63/31X |
| 2,177,978 | 10/1939 | Darvie | 63/20 X |
| 2,427,257 | 9/1947 | Campbell | 63/20 |
| 3,968,661 | 7/1976 | Williams | 63/31 |

FOREIGN PATENT DOCUMENTS

| | | | |
|---|---|---|---|
| 1,242,237 | 12/1959 | France | 63/31 |
| 263,280 | 12/1926 | United Kingdom | 63/31 |

OTHER PUBLICATIONS

Kind - page T-65 of S. Kind & Sons Jewelry, "Catalogue T for 1916".

*Primary Examiner*—F. Barry Shay
*Attorney, Agent, or Firm*—C. B. Messenger

[57] ABSTRACT

A pin, pendant or other charm for personal wear having a decorative cover providing a display or viewing zone where index markings, various color pieces, symbols, or other code identifying elements may be selectively exposed for accented observation. In embodiments of the invention one movable element having a plurality of distinct index units thereon is disposed behind the cover whereby only one or a limited number of index units is viewable at the viewing zone at any one time. A rotatable index or color wheel having a plurality of separate color zones is provided as one example of the invention. For such example each separate index color is coordinated by a provided code so that a message will be transmitted by the wearer and understood by a knowing observer. Position holding catches and fastening or mounting devices are provided.

2 Claims, 8 Drawing Figures

CODED CHARM DEVICE

BACKGROUND OF THE INVENTION

In keeping with present social practices, it is believed that it would be advantageous if associates, companions, or even strangers might know or have some indication of the present feelings and attitudes of individuals that they may meet or observe. Many individuals today enjoy a new freedom and are less inhibited than they may have been in prior years with relation to social contacts. However, there is still a substantial potential for further ways to express individual moods, thought, attitudes, desires or selection. In order to expand the potential for an individual's expression of such feelings, the present code signal type of charm, amulet or talisman is provided.

SUMMARY OF THE INVENTION

In keeping with the present concept and invention, a charm type device is provided for individual wear which makes it easily possible for the wearer to change index markings that are to be selected for display so that messages in keeping with an established code can be exchanged at least between the wearer and one knowing observer. The index markings which are to be displayed can be numerals, symbols, different color pieces, variously colored gems or the like, that can be selectively moved to a defined position for prominant display. In an embodiment of the invention, variously colored chips or segments are disposed about a rotatable wheel for movement with the wheel to a position of registration with a display opening. A single color or a multiple color combination can then be displayed for accent or observation in order to express a desired message. Where a wheel type index selector is used, knurled edges provide a convenient thumb or finger gripping surface that will facilitate changes of the displayed code, while the same knurling is used cooperatively with a catch to hold selected displays in position. Since the charm is intended for personal wear, various fasteners may be applied so that the charm can be used as a necklace, a tie clasp, belt buckle, pin, pendant, bracelet or other jewelry type device. Features of embodiments of the invention are shown in the accompanying drawings.

DESCRIPTION OF THE PREFERRED EMBODIMENTS

Figure 1:
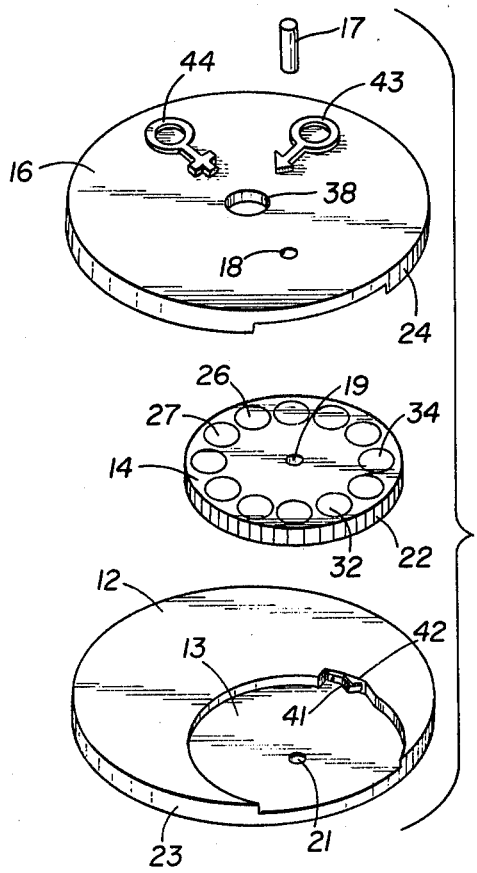
FIG. 1 is an exploded perspective drawing showing components of an embodiment of the invention in disassembled relationship.
Figure 2:
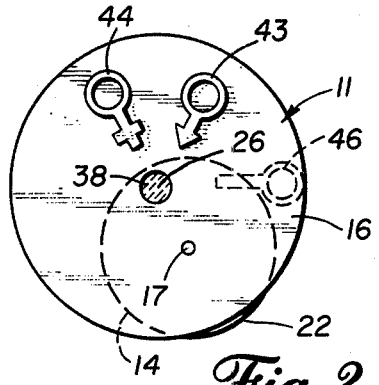
FIG.2 is a top plan view of an assembled embodiment.
Figure 3:
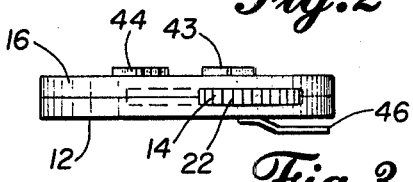
FIG. 3 is a side view thereof.
Figure 4:
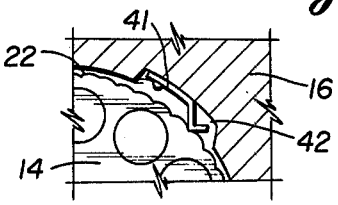
FIG. 4 is a partial cross-sectional elevation showing features of a catch mechanism.

The total representation of FIG. 1 is a pendant or charm 11 which is here shown in disassembled relationship with assembled illustrations thereof being presented in FIGS. 2 and 3. In FIG. 1 it is seen that a base component 12 is provided which has a cental recess 13 adapted to receive an index or color wheel 14. A decorative top or closure 16 is also provided. When the main pieces are in assembled relationship, a sandwich type construction is provided in which the index wheel 14 is disposed within the receptacle 13 and is held for rotation therein about a pivot pin 17. The pivot pin 17 passes through a pivot opening 18 in the top 16, the central opening 19 in index color wheel 14, and through a base opening 21 in the base 12. While the holes 18 and 21 are shown as through openings, either or both could be simply a blind bore adapted to receive the ends of pivot pin 17 without the pin being observeable from either the front or back sides of the charm 11. The pivot 17 and the receptacles therefor are eccentrically positioned on base 12 and closure 16, and, accordingly, the serrated and knurled edges 22 of wheel 14 are exposed past the limiting side walls 23 and 24 for the base 12 and top or cover 16. The knurled edge makes it possible to rotate the index color wheel 14 to selected positions where the separate color disks 26, 27, 32, 34 or other index markings on the upper face of wheel 14 may be selectively exposed to view through the central display opening 38 provided through the top cover 16. A ratchet type of catch 41 is preferably disposed in recess 42 within the base 12 at a position where the inherent resilience of the catch itself or other spring force will hold it in engagement with the knurled edge 22 on color index wheel 14. When properly arranged, as further shown in FIGS. 2 and 3, the knurled edge 22 will be exposed so that it can also be engaged by the user's thumb or finger to facilitate movement of wheel 14 to selected or desired positions.

In use the wearer will select a color, such as the color 26, or other index marking for display through opening 38. Such individual color or an alternately provided index marking then provides a display or coded message to observers that may know or that may have access to coding information or charts provided at the time that the charm pieces 11 are sold. Since the charms are to be displayed on the person, various symbols or designs may be provided on the front face of closure 16, such as the male and female symbols 43 and 44. As examples of the symbols and decoration that might be provided, a display of all the zodiac signs or a single selected design might be used. In similar manner it should be recognized that the index materials provided on the wheel 14 could likewise simply be numerals, zodiac signs, etc. If the charm is to be used as a pendant, an eye piece 46 can be provided, or a hole could simply be drilled through the charm to receive a ring or chain piece.

Figure 5:
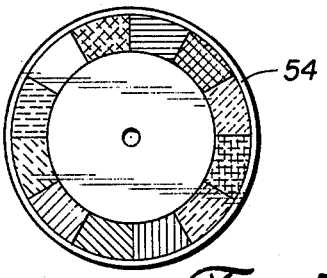
FIG. 5 is a top plan view of a color index wheel for a separate embodiment of the invention.
Figure 6:
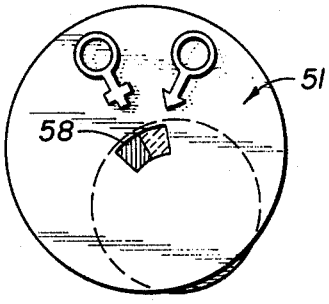
FIG. 6 is a top plan view of such separate embodiment as assembled.

An alternate embodiment of the invention is shown in FIGS. 5 and 6. Here the charm 51 is of the same general shape, construction and configuration as that previously described, but the display opening 58 is of larger size so that the colors or index markings being displayed will be more prominant. To obtain this effect the display opening 58 is a shaped opening displaying a segment of the total disk shape of the wheel 54. With this arrangement it would be possible to more prominently display a pair of side-by-side colors or index markings simultaneously.

Figure 7:
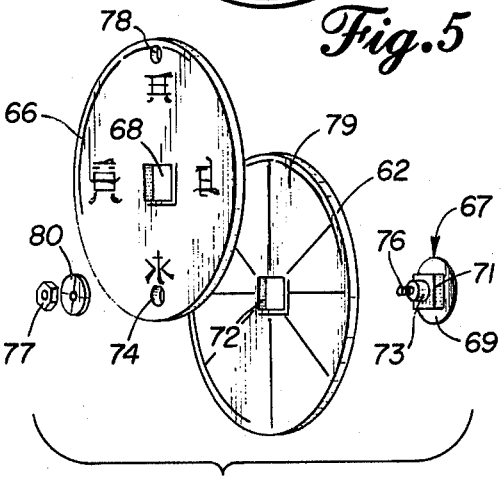
FIG. 7 is an exploded perspective view of a further embodiment of the invention.

A further embodiment of the invention is shown in FIG. 7. Here the coding and display features of the device are obtained through use of existing oriental coins. The coins in FIG. 7 have, when in their as-minted condition, respective central apertures indicated at 68 and 72. Two coins are used in assembled relationship so that a desired index color or marking will be displayed through the central square opening 68 of a top or cover coin 66. Various colors are provided in segment disposition on the face of a base or support coin 62. In order to hold the coins in assembled relationship, a fastener 67 is provided. Desirably, the fastener has a head 69 and a shank 71 of size adapted to pass through the central opening 72 of the support coin 62. A shoulder segment 73 is used that is adapted for rotatable reception in a mounting hole 74 provided by the cover coin 66. A threaded segment 76 on fastener 67 may be engaged by a threaded nut 77, a push nut or other type of securing device to hold the fastener in position with the support coin 62 then being rotatably disposed behind the cover coin 66. A further hole 78 is provided at the top of the cover or non-rotating coin 66 to receive a ring, chain or other support. As in the previous embodiments, a plurality of index segment positions 79 are possible. Colors, if desired, can be glazed on the face of the coin at such segment positions, or index markings could themselves be applied. Since most oriental coins have symbols and markings circumferentially displayed about the coin, the markings presently on a coin face could themselves become identified with separate coded displays.

When this embodiment of the invention is assembled and in use, one selected color will be presented at the display opening 68. A plurality of the remaining colors will also be in view as exposed beneath the lower rim of the top or cover coin 66. If attractive colors are used, this feathered display arrangement can add to the visual attractiveness of the device and can as well serve as an additional code device. As in the previous embodiment, a catch can be provided on the back of the cover coin 66 to hold the wheel coin 62 in adjusted position, or it would be possible by tightening down on the nut 77 or other fastener to hold the two coins in a fixed adjusted position. A clutch washer 80 is provided as an element of the illustrated embodiment in order to provide for selectively fixed positioning for this unit.

Figure 8:
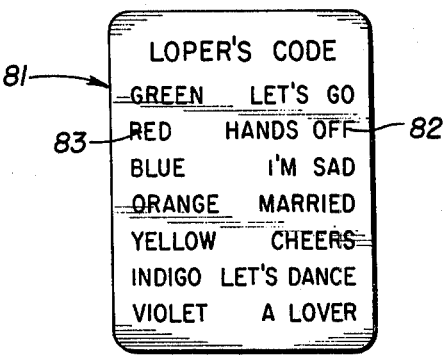
FIG. 8 is a top plan view of a code card for use with embodiments of the invention.

In FIG. 8 a representative code card 81 is shown. For the particular card various messages 82 are displayed in one column, while the code color or index 83 is in an adjacent position. It is intended in connection with the sale of the embodiments of the invention that a code will be provided either as a separate card as illustrated or as an element of packaging for the devices. Since the devices are intended for various use in addition to use as pendants or charm pieces, it should be recognized that other fastener elements, such as jewelry clips, tie clasps, wrist bands, etc. may be used to assure support and display of the devices.

I claim:

1. As an item of jewelry for wear on the person at positions for prominent display and for viewing by observers, a code annunciator charm device comprising a first support element, a second element disposed in juxtaposition to said support element whereby viewing of one said element is at least partially occluded by the presence of the other, a plurality of code related index markings at spaced positions on the partially occluded element, cooperative means permitting limited relative movement between said first and second elements whereby less than all of said separate index markings are at any one time selectively movable to a non-occluded position for display, said code annunciator charm device further comprising use of at least one coin of the type having an opening through the face thereof when in an as-minted condition as one of said elements to provide said non-occluding display.

2. The code annunciator charm as set forth in claim 1 wherein both said support and second elements are such coins with one minted opening providing the desired non-occluding display and the minted opening of said second coin being used as a component of said cooperative means.

* * * * *